US010196859B2

(12) United States Patent
Stockey et al.

(10) Patent No.: US 10,196,859 B2
(45) Date of Patent: Feb. 5, 2019

(54) DRILL BITS, ROTATABLE CUTTING STRUCTURES, CUTTING STRUCTURES HAVING ADJUSTABLE ROTATIONAL RESISTANCE, AND RELATED METHODS

(71) Applicant: Baker Hughes Incorporated, Houston, TX (US)

(72) Inventors: David A. Stockey, The Woodlands, TX (US); Reed W. Spencer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 217 days.

(21) Appl. No.: 15/060,991

(22) Filed: Mar. 4, 2016

(65) Prior Publication Data

US 2017/0254150 A1 Sep. 7, 2017

(51) Int. Cl.

| | |
|---|---|
| ***E21B 10/08*** | (2006.01) |
| ***E21B 10/14*** | (2006.01) |
| ***E21B 3/00*** | (2006.01) |
| ***E21B 7/06*** | (2006.01) |
| ***E21B 10/567*** | (2006.01) |
| *E21B 3/04* | (2006.01) |
| *E21B 44/00* | (2006.01) |
| *E21B 47/00* | (2012.01) |

(52) U.S. Cl.

CPC ..... *E21B 10/14* (2013.01); *E21B 3/00* (2013.01); *E21B 7/064* (2013.01); *E21B 10/567* (2013.01); *E21B 3/04* (2013.01); *E21B 44/00* (2013.01); *E21B 47/00* (2013.01)

(58) Field of Classification Search

CPC ..... E21B 10/14; E21B 10/08; E21B 12/02

See application file for complete search history.

(56) References Cited

U.S. PATENT DOCUMENTS 3,853,184 A * 12/1974 McCullough ..... E21B 12/02 175/39
4,690,228 A * 9/1987 Voelz ..... E21B 10/18 175/24
5,211,510 A 5/1993 Kimura et al.

(Continued)

OTHER PUBLICATIONS

International Search Report for International Application No. PCT/US2017/020399 dated May 29, 2017, 3 pages.

(Continued)

*Primary Examiner* — Kipp C Wallace
(74) *Attorney, Agent, or Firm* — Traskbritt

(57) ABSTRACT

An earth-boring tool may include a body and at least one rotatable cutting structure assembly. The rotatable cutting structure assembly may include a leg, a rotatable cutting structure rotatably coupled to the leg, and a resistance actuator configured to impose rotational resistance on the rotatable cutting structure relative to the leg. An earth-boring to may include a plurality of rotatable cutting structure assemblies coupled to the bit body and a plurality of blades coupled to the body. A method of drilling a borehole may include rotating an earth-boring tool within the borehole, causing rotational resistance to be imposed on at least one rotatable cutting structure of the earth-boring tool, causing a blade of the earth-boring tool to be pushed into a sidewall of the borehole, and side cutting the sidewall of the borehole with the blade.

20 Claims, 12 Drawing Sheets

(56) References Cited

U.S. PATENT DOCUMENTS 6,484,819 B1* 11/2002 Harrison ..... E21B 7/064 166/66
6,601,660 B1 8/2003 Xiang et al.
6,634,441 B2* 10/2003 Palaschenko ..... E21B 12/02 175/39
7,819,208 B2 10/2010 Pessier et al.
7,845,435 B2 12/2010 Zahradnik et al.
8,047,307 B2 11/2011 Pessier et al.
8,336,646 B2 12/2012 Kulkarni
8,950,514 B2 2/2015 Buske et al.
9,004,198 B2 4/2015 Kulkarni
2002/0112887 A1* 8/2002 Harrison ..... E21B 7/04 175/27
2004/0238222 A1* 12/2004 Harrison ..... E21B 7/04 175/61
2011/0079444 A1 4/2011 Kulkarni
2011/0315452 A1* 12/2011 Buske ..... E21B 10/14 175/336
2012/0103690 A1* 5/2012 Patel ..... E21B 10/08 175/57
2013/0192898 A1* 8/2013 Porel ..... E21B 7/064 175/61
2013/0313021 A1* 11/2013 Zahradnik ..... E21B 7/00 175/57
2014/0202771 A1 7/2014 Zahradnik et al.
2015/0211303 A1 7/2015 Buske et al.
2015/0337603 A1 11/2015 Schroder
2017/0051579 A1* 2/2017 Hay ..... E21B 41/00

OTHER PUBLICATIONS

International Written Opinion for International Application No. PCT/US2017/020399 dated May 29, 2017, 8 pages.

* cited by examiner

DRILL BITS, ROTATABLE CUTTING STRUCTURES, CUTTING STRUCTURES HAVING ADJUSTABLE ROTATIONAL RESISTANCE, AND RELATED METHODS

TECHNICAL FIELD

This disclosure relates generally to earth-boring tools having rotatable cutting structures. This disclosure also relates to earth-boring tools having blades with fixed cutting elements as well as rotatable cutting structures. This disclosure further relates to earth-boring tools having rotatable cutting structure assemblies having adjustable rotational resistance.

BACKGROUND

Oil wells (wellbores) are usually drilled with a drill string. The drill string includes a tubular member having a drilling assembly that includes a single drill bit at its bottom end. The drilling assembly may also include devices and sensors that provide information relating to a variety of parameters relating to the drilling operations ("drilling parameters"), behavior of the drilling assembly ("drilling assembly parameters") and parameters relating to the formations penetrated by the wellbore ("formation parameters"). A drill bit and\or reamer attached to the bottom end of the drilling assembly is rotated by rotating the drill string from the drilling rig and/or by a drilling motor (also referred to as a "mud motor") in the bottom hole assembly ("BHA") to remove formation material to drill the wellbore. Many wellbores are drilled along non-vertical, contoured trajectories in what is often referred to as directional drilling. For example, a single wellbore may include one or more vertical sections, deviated sections and horizontal sections extending through differing types of rock formations.

Directional and horizontal drilling are often used to reach targets beneath adjacent formations, reduce the footprint of gas field development, increase the length of the "pay zone" in a wellbore, deliberately intersect fractures, construct relief wells, and install utility services beneath lands where excavation is impossible or extremely expensive. Directional drilling is often achieved using rotary steerable systems ("RSS") or drilling motors, which are known in the art.

BRIEF SUMMARY

Some embodiments of the present disclosure include an earth-boring tool. The earth-boring tool may include a bit body and at least one cutting structure assembly rotatably coupled to the bit body. The at least one cutting structure assembly may be rotatably mounted to a leg extending from the bit body and operably coupled to a resistance actuator configured to impose rotational resistance on the cutting structure relative to the leg.

In additional embodiments, the earth-boring tool may include a bit body, a plurality of roller cutter assemblies coupled to the bit body, and a plurality of blades coupled to the bit body. Each roller cutter assembly may include a leg extending from the bit body, a roller cutter rotatably coupled to the leg, and a resistance actuator configured to impose rotational resistance on the roller cutter relative to the leg.

Some embodiments of the present disclosure include a method of drilling a borehole. The method may include rotating an earth-boring tool within the borehole, causing rotational resistance to be imposed on at least one roller cutter of the earth-boring tool, causing a portion of the earth-boring tool to be pushed into a sidewall of the borehole, and side cutting the sidewall of the borehole with the portion of the earth-boring tool.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
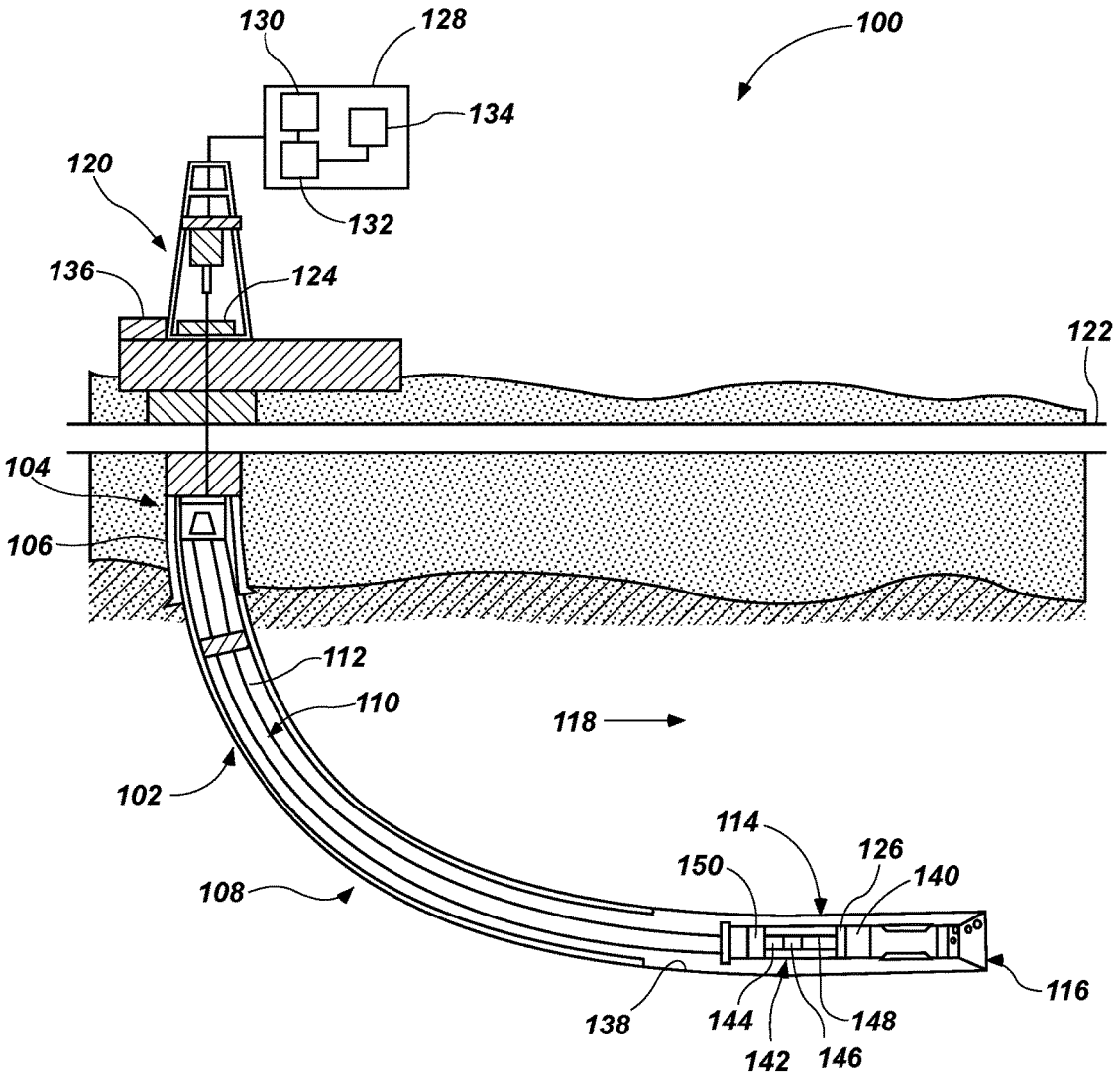
FIG. 1 is a schematic diagram of a wellbore system comprising a drill string that includes an earth-boring tool according to an embodiment of the present disclosure.

The illustrations presented herein are not actual views of any drill bit, roller cutter, or any component thereof, but are merely idealized representations, which are employed to describe the present invention.

As used herein, the terms "bit" and "earth-boring tool" each mean and include earth-boring tools for forming, enlarging, or forming and enlarging a borehole. Non-limiting examples of bits include fixed cutter (drag) bits, fixed cutter coring bits, fixed cutter eccentric bits, fixed cutter bi-center bits, fixed cutter reamers, expandable reamers with blades bearing fixed cutters, and hybrid bits including both fixed cutters and rotatable cutting structures (roller cones).

As used herein, the term "cutting structure" means and include any element that is configured for use on an earth-boring tool and for removing formation material from the formation within a wellbore during operation of the earth-boring tool. As non-limiting examples, cutting structures include rotatable cutting structures, commonly referred to in the art as "roller cones" or "rolling cones."

As used herein, the term "cutting elements" means and includes, for example, superabrasive (e.g., polycrystalline diamond compact or "PDC") cutting elements employed as fixed cutting elements, as well as tungsten carbide inserts and superabrasive inserts employed as cutting elements mounted to rotatable cutting structures, such as roller cones.

As used herein, the term "resistance actuator" means and includes a mechanism for decreasing rotational speed of a rotatable cutting structure of an earth-boring tool below a speed attributable to contact with a formation being drilled or increasing rotational speed of a rotatable cutting structure of an earth-boring tool above a speed attributable to contact with a formation being drilled. As used herein, the term "rotational resistance" means and includes resistance to either decrease or increase rotational speed of a rotatable cutting structure in comparison to a speed attributable to contact with a formation being drilled.

As used herein, any relational term, such as "first," "second," "top," "bottom," etc., is used for clarity and convenience in understanding the disclosure and accompanying drawings, and does not connote or depend on any specific preference or order, except where the context clearly indicates otherwise. For example, these terms may refer to an orientation of elements of an earth-boring tool when disposed within a borehole in a conventional manner. Furthermore, these terms may refer to an orientation of elements of an earth-boring tool when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include an earth-boring tool for directional drilling. For example, the earth-boring tool may include side cutting abilities. In some embodiments, the earth-boring tool may include at least one rotatable cutting structure, such as a roller cone, operably coupled to a resistance actuator. The resistance actuator may impose rotational resistance on the at least one roller cutter. Imposing rotational resistance on the at least one rotatable cutting structure may cause the earth-boring bit to pivot about the at least one rotatable cutting structure and to push other portions (e.g., a blade having fixed cutting elements) of the earth-boring tool into a sidewall of a borehole of which the earth-boring tool is drilling. Pushing a blade into the sidewall of the borehole may cause the earth-boring tool to side cut into the sidewall of the borehole and may change a trajectory of the earth-boring tool. In some embodiments, the earth-boring tool may be a hybrid bit including both blades and rotatable cutting structures. In other embodiments, the earth-boring tool may include only rotatable cutting structures (e.g., a tricone bit).

FIG. 1 is a schematic diagram of an example of a drilling system 100 that may utilize the apparatuses and methods disclosed herein for drilling boreholes. FIG. 1 shows a borehole 102 that includes an upper section 104 with a casing 106 installed therein and a lower section 108 that is being drilled with a drill string 110. The drill string 110 may include a tubular member 112 that carries a drilling assembly 114 at its bottom end. The tubular member 112 may be made up by joining drill pipe sections or it may be a string of coiled tubing. A drill bit 116 may be attached to the bottom end of the drilling assembly 114 for drilling the borehole 102 of a selected diameter in a formation 118.

The drill string 110 may extend to a rig 120 at surface 122. The rig 120 shown is a land rig 120 for ease of explanation. However, the apparatuses and methods disclosed equally apply when an offshore rig 120 is used for drilling boreholes under water. A rotary table 124 or a top drive may be coupled to the drill string 110 and may be utilized to rotate the drill string 110 and to rotate the drilling assembly 114, and thus the drill bit 116 to drill the borehole 102. A drilling motor 126 may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the borehole 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of the various devices and sensors 140 in the drilling assembly 114. The sensors 140 may include one or more of sensors 140 that determine acceleration, weight on bit, torque, pressure, cutting element positions, rate of penetration, inclination, azimuth formation/lithology, etc. In some embodiments, the surface control unit 128 may include a processor 130 and a data storage device 132 (or a computer-readable medium) for storing data, algorithms, and computer programs 134. The data storage device 132 may be any suitable device, including, but not limited to, a read-only memory (ROM), a random-access memory (RAM), a flash memory, a magnetic tape, a hard disk, and an optical disk. During drilling, a drilling fluid from a source 136 thereof may be pumped under pressure through the tubular member 112, which discharges at the bottom of the drill bit 116 and returns to the surface 122 via an annular space (also referred as the "annulus") between the drill string 110 and an inside sidewall 138 of the borehole 102.

The drilling assembly 114 may further include one or more downhole sensors 140 (collectively designated by numeral 140). The sensors 140 may include any number and type of sensors 140, including, but not limited to, sensors generally known as the measurement-while-drilling (MWD) sensors or the logging-while-drilling (LWD) sensors, and sensors 140 that provide information relating to the behavior of the drilling assembly 114, such as drill bit rotation (revolutions per minute or "RPM"), tool face, pressure, vibration, whirl, bending, and stick-slip. The drilling assembly 114 may further include a controller unit 142 that controls the operation of one or more devices and sensors 140 in the drilling assembly 114. For example, the controller unit 142 may be disposed within the drill bit 116 (e.g., within a shank 208 and/or crown 210 of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, and control downhole devices and sensors 140, and communicate data information with the surface control unit 128 via a two-way telemetry unit 150.

Figure 2:
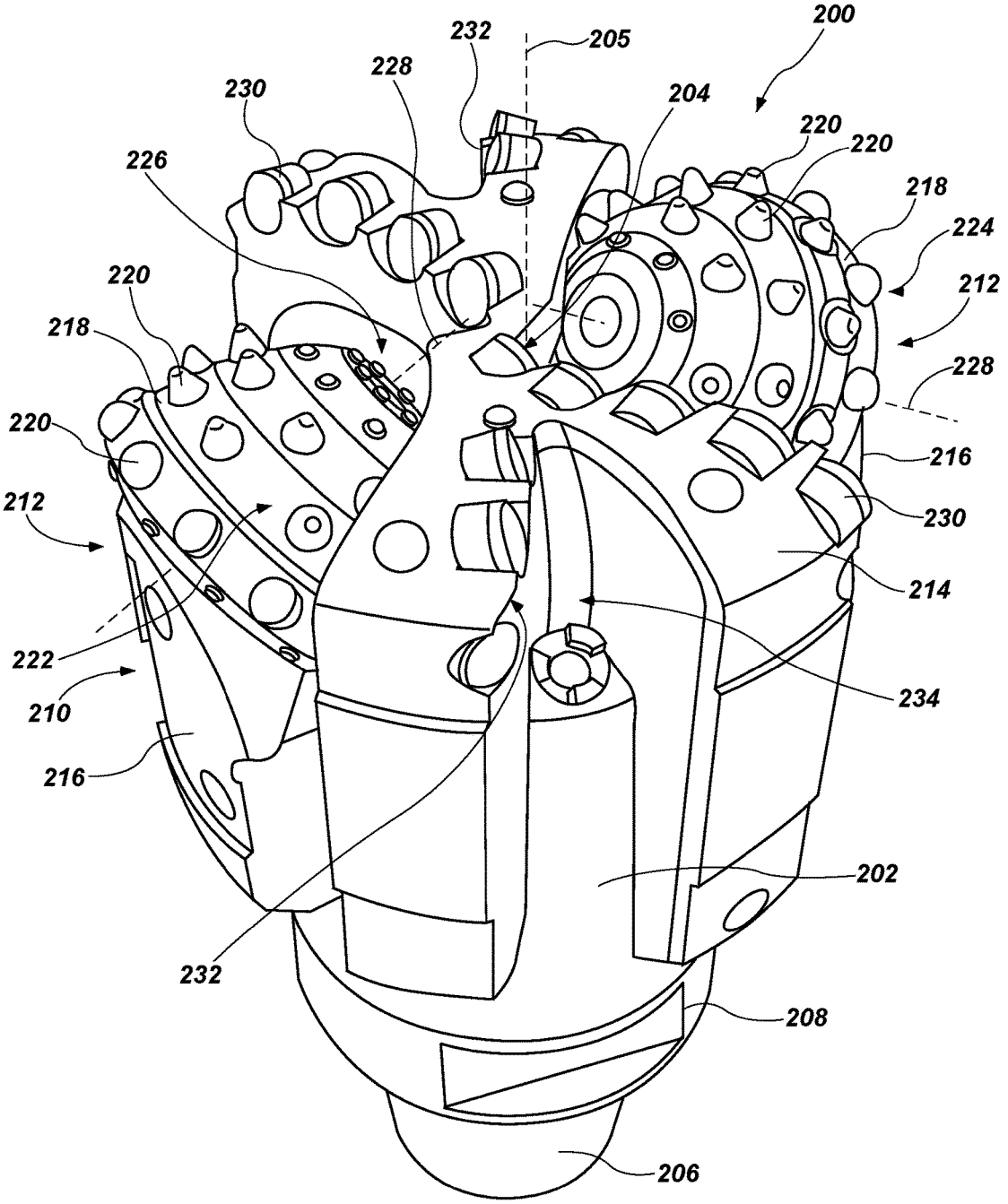
FIG. 2 is a bottom perspective view of an earth-boring tool having rotatable cutting structures according to an embodiment of the present disclosure.

FIG. 2 is a bottom perspective view of an earth-boring tool 200 (inverted from its normal orientation during drilling that may be used with the drilling assembly 114 of FIG. 1 according to an embodiment of the present disclosure. The earth-boring tool 200 may include a drill bit having one or more rotatable cutting structures in the form of roller cones. For example, the earth-boring tool 200 may be a hybrid bit (e.g., a drill bit having both roller cones and blades) as shown in FIG. 2, or the earth-boring tool 200 may comprise a conventional roller cone bit (e.g., tricone bit). Furthermore, the earth-boring tool 200 may include any other suitable drill bit or earth-boring tool 200 having one or more rotatable cutting structures for use in drilling and/or enlarging a borehole 102 in a formation 118 (FIG. 1).

The earth-boring tool 200 may comprise a body 202 including a neck 206, a shank 208, and a crown 210. In some embodiments, the bulk of the body 202 may be constructed of steel, or of a ceramic-metal composite material including particles of hard material (e.g., tungsten carbide) cemented within a metal matrix material. The body 202 of the earth-boring tool 200 may have an axial center 204 defining a center longitudinal axis 205 that may generally coincide with a rotational axis of the earth-boring tool 200. The center longitudinal axis 205 of the body 202 may extend in a direction hereinafter referred to as an "axial direction."

The body 202 may be connectable to a drill string 110 (FIG. 1). For example, the neck 206 of the body 202 may have a tapered upper end having threads thereon for connecting the earth-boring tool 200 to a box end of a drilling assembly 114 (FIG. 1). The shank 208 may include a lower straight section that is fixedly connected to the crown 210 at a joint. In some embodiments, the crown 210 may include a plurality of rotatable cutting structure assemblies 212 and a plurality of blades 214.

The plurality of rotatable cutting structure assemblies 212 may include a plurality of legs 216 and a plurality of rotatable cutting structures 218, each respectively mounted to a leg 216. The plurality of legs 216 may extend from an end of the body 202 opposite the neck 206 and may extend in the axial direction. The plurality of blades 214 may also extend from the end of the body 202 opposite the neck 206 and may extend in both the axial and radial directions. Each blade 214 may have multiple profile regions as known in the art (cone, nose, shoulder, gage). In some embodiments, at least one blade 214 may be located between adjacent legs 216 of the plurality of legs 216. For example, in the embodiment shown in FIG. 2, multiple blades 214 of the plurality of blades 214 may be located between adjacent legs 216 of the plurality of legs 216. In other embodiments, only one blade 214 of the plurality of blades 214 may be oriented between adjacent legs 216. In some embodiments, the plurality of rotatable cutting structure assemblies 212 may not include a plurality of legs 216 but may be mounted directed to the crown 210 on the body 202 of the earth-boring tool 200.

Fluid courses 234 may be formed between adjacent blades 214 of the plurality of blades 214 and may be provided with drilling fluid by ports located at the end of passages leading from an internal fluid plenum extending through the body 202 from a tubular shank 208 at the upper end of the earth-boring tool 200. Nozzles may be secured within the ports for enhancing direction of fluid flow and controlling flow rate of the drilling fluid. The fluid courses 234 extend to junk slots extending axially along the longitudinal side of earth-boring tool 200 between blades 214 of the plurality of blades 214.

Each rotatable cutting structure 218 may be rotatably mounted to a respective leg 216 of the body 202. For example, each rotatable cutting structure 218 may be mounted to a respective leg 216 with one or more of a journal bearing and rolling-element bearing. Many such bearing systems are known in the art and may be employed in embodiments of the present disclosure.

Each rotatable cutting structure 218 may have a plurality of cutting elements 220 thereon. In some embodiments, the plurality of cutting elements 220 of each rotatable cutting structure 218 may be arranged in generally circumferential rows on an outer surface 222 of the rotatable cutting structure 218. In other embodiments, the cutting elements 220 may be arranged in an at least substantially random configuration on the outer surface 222 of the rotatable cutting structure 218. In some embodiments, the cutting elements 220 may comprise preformed inserts that are interference fitted into apertures formed in each rotatable cutting structure 218. In other embodiments, the cutting elements 220 of the rotatable cutting structure 218 may be in the form of teeth integrally formed with the material of each rotatable cutting structure 218. The cutting elements 220, if in the form of inserts, may be formed from tungsten carbide, and optionally have a distal surface of polycrystalline diamond, cubic boron nitride, or any other wear-resistant and/or abrasive or superabrasive material.

In some embodiments, each rotatable cutting structure 218 of the plurality of rotatable cutting structures 218 may have a general conical shape, with a base end 224 (e.g., wide end and radially outermost end 224) of the conical shape being mounted to a respective leg 216 and a tapered end 226 (e.g., radially innermost end 226) being proximate (e.g., at least substantially pointed toward) the axial center 204 of the body 202 of the earth-boring tool 200. In other embodiments, each rotatable cutting structure 218 of the plurality of rotatable cutting structures 218 may not have a generally conical shape but may have any shape appropriate for rotatable cutting structure 218. For example, in some embodiments, the earth-boring tool 200 may include one or more of the rotatable cutting structures 218 described in U.S. Pat. No. 8,047,307, to Pessier et al., issued Nov. 1, 2011, U.S. Pat. No. 9,004,198, to Kulkarni, issued Apr. 14, 2015, and U.S. Pat. No. 7,845,435, to Zahradnik et al., issued Dec. 7, 2010, the disclosures of which are each incorporated herein by reference.

Each rotatable cutting structure 218 of the plurality of rotatable cutting structures 218 may have a rotational axis 228 about which each rotatable cutting structure 218 may rotate during use of the earth-boring tool 200 in a drilling operation. In some embodiments, the rotational axis 228 of each rotatable cutting structure 218 of the plurality of rotatable cutting structures 218 may intersect the axial center 204 of the earth-boring tool 200. In other embodiments, the rotational axis 228 of one or more rotatable cutting structures 218 of the plurality of rotatable cutting structures 218 may be offset from the axial center 204 of the earth-boring tool 200. For example, the rotational axis 228 of one or more rotatable cutting structures 218 of the plurality of rotatable cutting structures 218 may be laterally offset (e.g., angularly skewed) such that the rotational axis 228 of the one of more rotatable cutting structures 218 of the plurality of rotatable cutting structures 218 does not intersect the axial center 204 of the earth-boring tool 200. In some embodiments, the radially innermost end 226 of each rotatable cutting structure 218 of the plurality of rotatable cutting structures 218 may be radially spaced from the axial center 204 of the earth-boring tool 200.

In some embodiments, the plurality of rotatable cutting structures 218 may be angularly spaced apart from each other around the longitudinal axis of the earth-boring tool 200. For example, a rotational axis 228 of a first rotatable cutting structure 218 of the plurality of rotatable cutting structures 218 may be circumferentially angularly spaced apart from a rotational axis 228 of a second rotatable cutting structure 218 by about 75° to about 180°. For example, in some embodiments, the rotatable cutting structures 218 may be angularly spaced apart from one another by about 120°. In other embodiments, the rotatable cutting structures 218 may be angularly spaced apart from one another by about 150°. In other embodiments, the rotatable cutting structures 218 may be angularly spaced apart from one another by about 180°. Although specific degrees of separation of rotational axes (i.e., number of degrees) are disclosed herein, one of ordinary skill in the art would recognize that the rotatable cutting structures 218 may be angularly spaced apart from one another by any suitable amount.

Each blade 214 of the plurality of blades 214 of the earth-boring tool 200 may include a plurality of cutting elements 230 fixed thereto. The plurality of cutting elements 230 of each blade 214 may be located in a row along a profile of the blade 214 proximate a rotationally leading face 232 of the blade 214.

In some embodiments, the plurality of cutting elements 220 of the plurality of rotatable cutting structures 218 and plurality of cutting elements 230 of the plurality of blades 214 may include PDC cutting elements 230. Moreover, the plurality of cutting elements 220 of the plurality of rotatable cutting structures 218 and plurality of cutting elements 230 of the plurality of blades 214 may include any suitable cutting element configurations and materials for drilling and/or enlarging boreholes.

Figure 3:
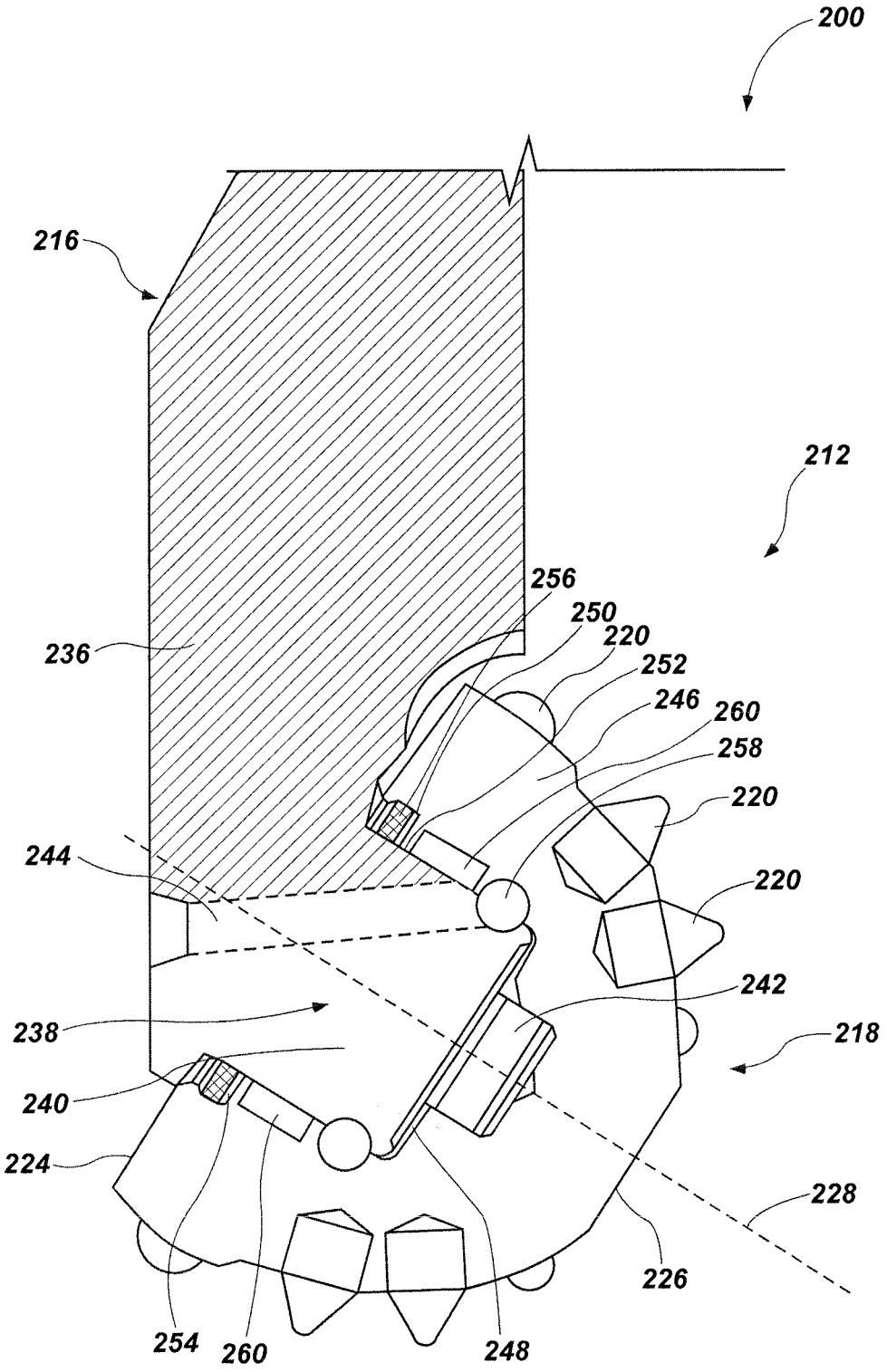
FIG. 3 is a partial cross-sectional view of a leg and rotatable cutting structure assembly of an earth-boring tool according to an embodiment of the present disclosure.

FIG. 3 is a partial cross-sectional view of a rotatable cutting structure assembly 212 of an earth-boring tool 200 according to an embodiment of the present disclosure. Some elements of the rotatable cutting structure assembly 212 are removed to better show internal elements of the rotatable cutting structure assembly 212. The leg 216 of the rotatable cutting structure assembly 212 may include a leg portion 236 and a head 238 for rotatably mounting rotatable cutting structure 218 to the leg portion 236 of the leg 216. The head 238 may include a main body portion 240 and a pilot portion 242, and a lubricant passage 244 may extend through the head 238 to an outer diameter of the main body portion 240 of the head 238. For example, the head 238 may be configured as described in U.S. Pat. No. 9,004,198, to Kulkarni, issued Apr. 14, 2015, the disclosure of which is incorporated in its entirety by reference herein. The main body portion 240 of the head 238 may extend from the leg portion 236 of the leg 216 at an acute angle relative to a longitudinal axis of the leg portion 236 of the leg 216. The pilot portion 242 may extend from a distal end of the main body portion 240. The lubricant passage 244 may extend through the head 238 and to an interface 252 of the head 238 and the rotatable cutting structure 218. A lubricant 254 may be disposed at the interface 252 of the head 238 and the rotatable cutting structure 218.

The rotatable cutting structure 218 of the rotatable cutting structure assembly 212 may include a body 246, a plurality of cutting elements 220, a cavity 248 for receiving the head 238, and a seal channel 250 defined in the body 246. The cavity 248 may be formed in the body 246 of the rotatable cutting structure 218 and may be sized and shaped to receive the head 238 of the leg 216 and to allow the rotatable cutting structure 218 to rotate about the head 238 and relative to the leg portion 236 of the leg 216. In some embodiments, a longitudinal axis of the head 238 may be orthogonal to a direction of rotation of the rotatable cutting structure 218. In other words, the rotational axis 228 of the rotatable cutting structure 218 and the longitudinal axis of the head 238 may be collinear. The plurality of cutting elements 220 of the rotatable cutting structure 218 may extend from an outer surface 222 of the rotatable cutting structure 218. The seal channel 250 may be defined in the body 246 of the rotatable cutting structure 218 and at an interface 252 of the head 238 of the leg 216 and the body 246 of the rotatable cutting structure 218. A seal 256 may be disposed in the seal channel 250 and may be serve to keep lubricant 254 from escaping from the interface 252 of the head 238 and the body 246 of the rotatable cutting structure 218. Furthermore, in some embodiments, at least one ball bearing assembly 258 may be disposed at the interface 252 of the head 238 and the body 246 of the rotatable cutting structure 218. For example, in some embodiments, the rotatable cutting structure assembly 212 may include the bearing assembly described in U.S. Pat. No. 9,004,198, to Kulkarni, issued Apr. 14, 2015, the disclosure of which is incorporated in its entirety by reference herein.

In accordance with embodiments of the present disclosure, the rotatable cutting structure assembly 212 further includes a resistance actuator 260 for applying a braking torque to the rotatable cutting structure 218. For example, the resistance actuator 260 may create rotational resistance between the rotatable cutting structure 218 and the head 238 of the leg 216. In other words, the resistance actuator 260 may impose at least some resistance to a rotation of the rotatable cutting structure 218 relative to the head 238 and leg portion 236 of the leg 216. Put another way, the resistance actuator 260, when actuated, may prevent the rotatable cutting structure 218 from freely rotating about the head 238 of the leg 216. As a result, the resistance actuator 260 may impose a braking torque (e.g., a non-zero braking torque) about the rotational axis 228 of the rotatable cutting structure 218. Furthermore, as a result, the resistance actuator 260, when actuated, may slow a rotation of the rotatable cutting structure 218 about the head 238 of the leg 216 of the bit body 202 that may result naturally by contacting a formation 118 during a drilling procedure. In some embodiments, the resistance actuator 260 may at least substantially stop rotation of the rotatable cutting structure 218. In some embodiments, the resistance actuator 260 may change a speed of rotation of the rotatable cutting structure 218 about the head 238 of the leg 216 of the bit body 202. For clarification and to facilitate description of the resistance actuator 260 and rotatable cutting structures 218, the resistance actuator 260 will be described herein as "imposing rotational resistance" on the rotatable cutting structure 218.

In some embodiments, the resistance actuator 260 may impose rotational resistance on the rotatable cutting structure 218 intermittently throughout full rotations or portions of rotations of the earth-boring tool 200. In some embodiments, the resistance actuator 260 may impose rotational resistance on the rotatable cutting structure 218 selectively throughout full rotations or portions of rotations of the earth-boring tool 200. In some embodiments, the resistance actuator 260 may impose rotational resistance on the rotatable cutting structure 218 continuously throughout full rotations or portions of rotations of the earth-boring tool 200.

In some embodiments, as shown in FIG. 3, the resistance actuator 260 may be disposed within the body 246 of the rotatable cutting structure 218 at the interface 252 of the body 246 of the rotatable cutting structure 218 and the head 238 of the leg 216. In some embodiments, the resistance actuator 260 may include one or more of resistance brakes (e.g., pads), electro-magnetic brakes, electro-mechanical brakes, a motor, a clutch, magneto-rheological fluid, an electro-rheological fluid, self-energizing brakes, eddy current brakes, or any other resistance creating apparatus.

Figure 4:
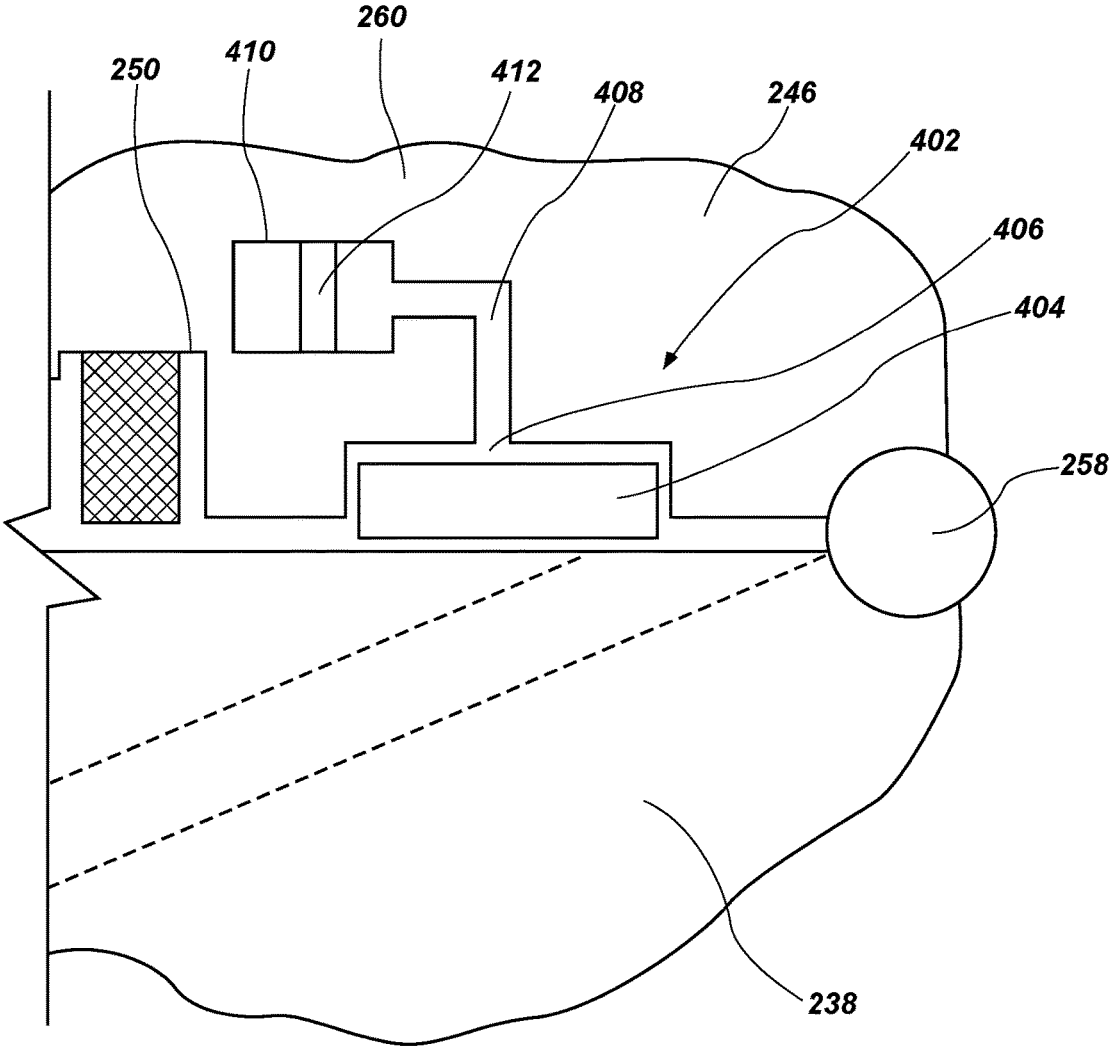
FIG. 4 is an enlarged partial cross-sectional view of a resistance actuator according to an embodiment of the present disclosure.

FIG. 4 is an enlarged partial cross-sectional view of a rotatable cutting structure assembly 212 having a resistance actuator 260 including resistance brakes 402. The resistance brakes 402 may include at least one pad 404, fluid 406, fluid lines 408, and a fluid chamber 410 having a piston 412. The at least one pad 404 may be disposed proximate the head 238 and may be configured to be press up against the head 238 when actuated. The fluid lines 408 may be operably coupled to the at least one pad 404 and may extend to the fluid chamber 410. The resistance brakes 402 may function similar to disc brakes, which are known in the art. For example, when actuated, the piston 412 may push fluid 406 out of the fluid chamber 410, through the fluid lines 408, and may cause the at least one pad 404 to be pressed up against the head 238 causing friction. Pressing the at least one pad 404 up against the head 238 of the leg 216 may impose rotational resistance on the rotatable cutting structure 218.

Figure 5:
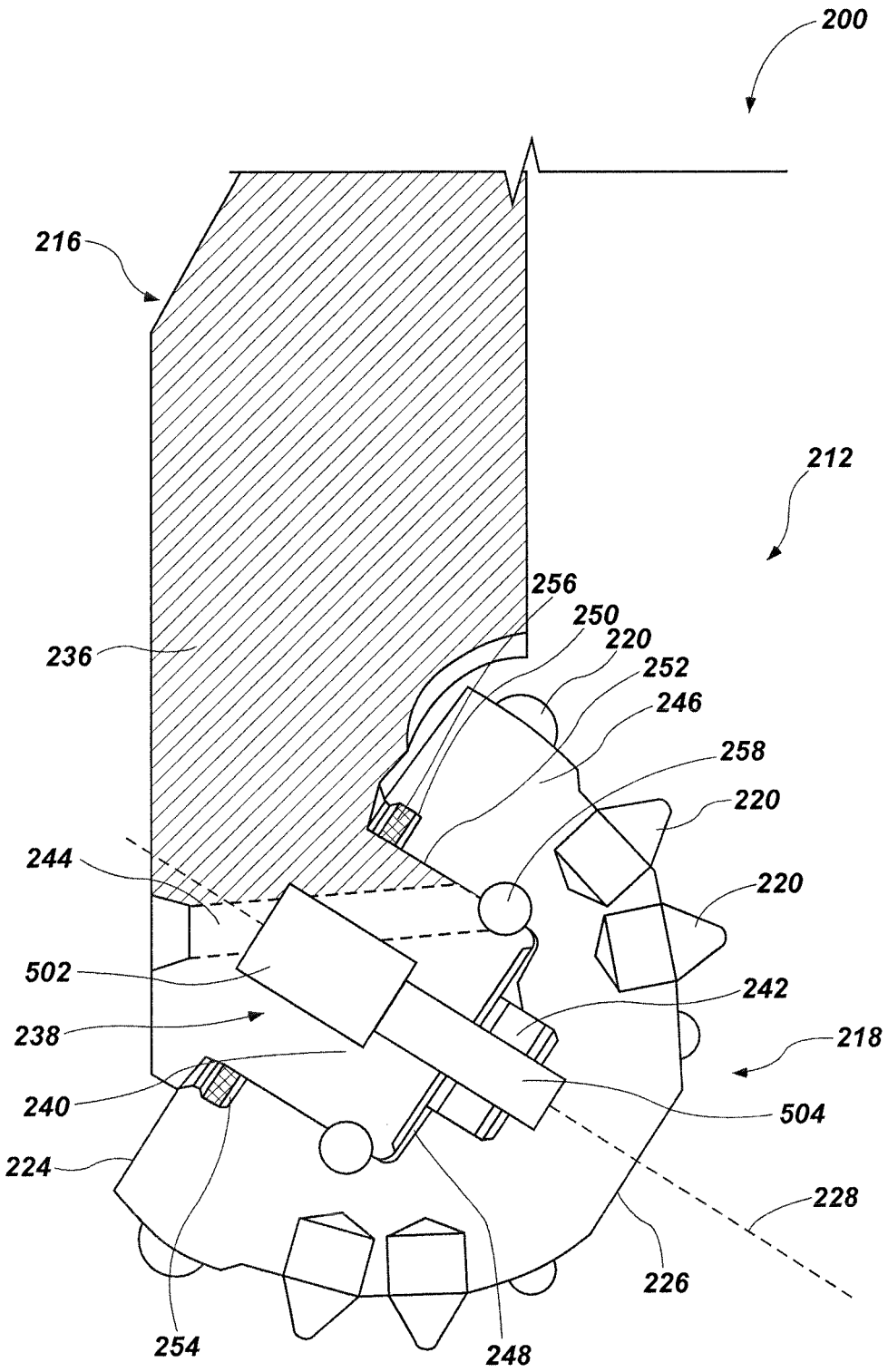
FIG. 5 is partial cross-sectional view of a leg and rotatable cutting structure assembly of an earth-boring tool having a resistance actuator according to an embodiment of the present disclosure.

FIG. 5 is a partial cross-sectional view of other rotatable cutting structure assembly 212 having a resistance actuator 260 including a motor 502 coupled to the rotatable cutting structure 218. In such embodiments, the resistance actuator 260 may include a shaft 504 fixedly coupled to the body 246 of the rotatable cutting structure 218 and extending into the head 238 of the leg 216 along the rotational axis 228 of the rotatable cutting structure 218. The motor 502 may be disposed within the head 238 of the leg 216 and may be operably coupled to the shaft 504. In some embodiments, the motor 502 may include a generator or any other apparatus for imposed torque on the rotatable cutting structure 218. When actuated, the motor 502 may engage with the shaft 504 and may cause the rotatable cutting structure 218 to have to turn the motor 502 against resistance provided by the motor 502 when rotating, which in turn, imposes rotational resistance to the rotatable cutting structure 218. Alternatively, the motor 502 may be actuated in a direction of rotation of the rotatable cutting structure 218 to increase the rotational speed of rotatable cutting structure 218 in excess of a speed attributable to contact with a subterranean formation.

Figure 6:
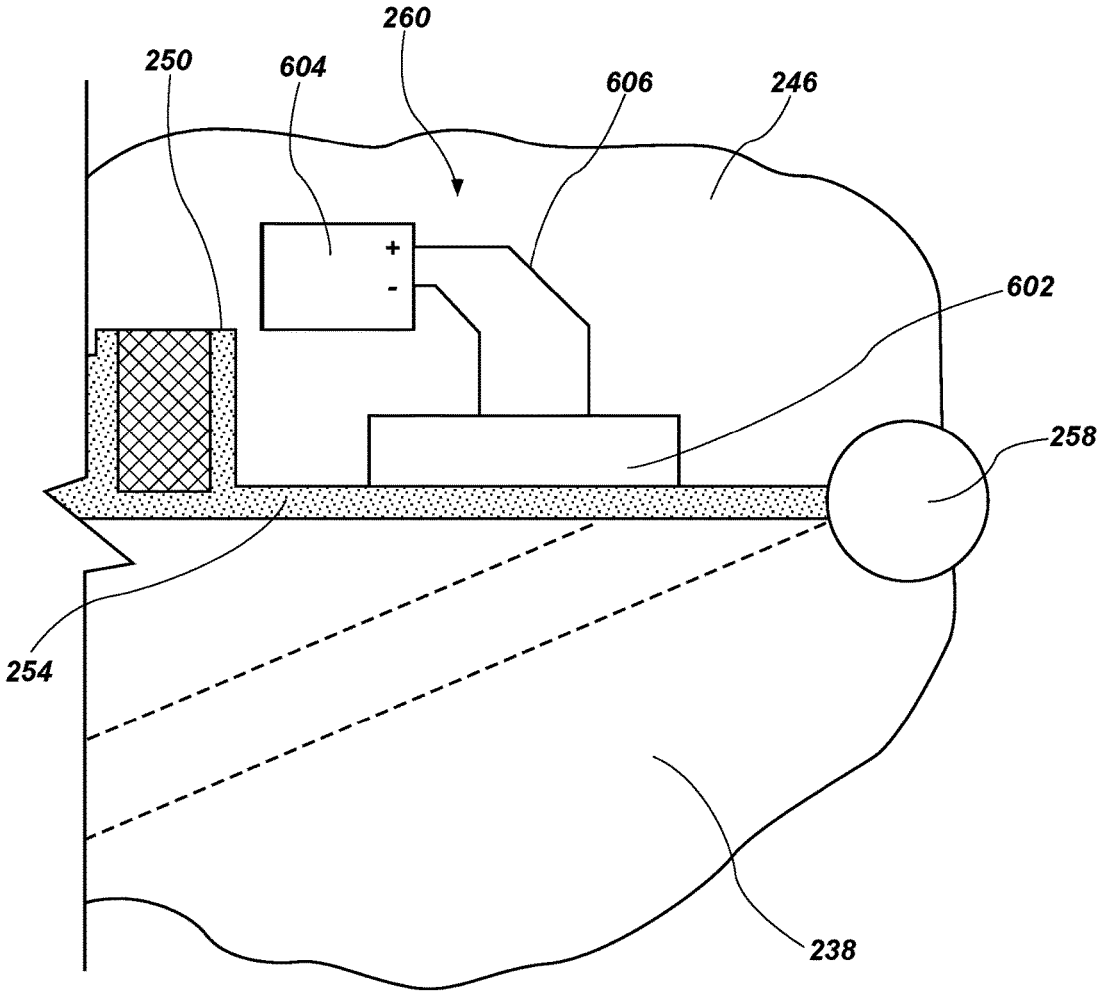
FIG. 6 is an enlarged partial cross-sectional view of a resistance actuator according to an embodiment of the present disclosure.

FIG. 6 is an enlarged partial cross-sectional view of a rotatable cutting structure assembly 212 having a resistance actuator 260 including magneto-rheological fluid or electro-rheological fluid as the resistance actuator 260. The resistance actuator 260 may further include at least one electromagnet 602 operably coupled to a power source 604 via electrical lines 606. The magneto-rheological fluid or electro-rheological fluid may serve as the lubricant 254 and may be disposed between the head 238 and the rotatable cutting structure 218 at the interface 252 of the head 238 and the rotatable cutting structure 218. The at least one electromagnet 602 may located and configured to adjust a viscosity of the magneto-rheological fluid or the electro-rheological fluid, and as a result, to adjust an amount of rotational resistance imposed on the rotatable cutting structure 218. For example, the at least one electromagnet 602 may be disposed proximate the interface 252 of the head 238 and the rotatable cutting structure 218 Increasing the viscosity of the magneto-rheological fluid or the electro-rheological fluid may increase an amount of rotational resistance imposed on the rotatable cutting structure 218. Furthermore, decreasing the viscosity of the magneto-rheological fluid or the electro-rheological fluid may decrease an amount of rotational resistance imposed on the rotatable cutting structure 218.

In some embodiments, a force required to impose rotational resistance on the rotatable cutting structure 218 may be relatively large. Accordingly, in some embodiments, the resistance actuator 260 may include self-energizing brakes (e.g., brakes that use force generated by friction to increase a clamping force) in order to require less input force (e.g., power) to impose the rotational resistance on the rotatable cutting structure 218. For example, in such embodiments, the resistance actuator 260 may include one or more of shoe drum brakes, band brakes, and dual servo brakes.

Figure 7:
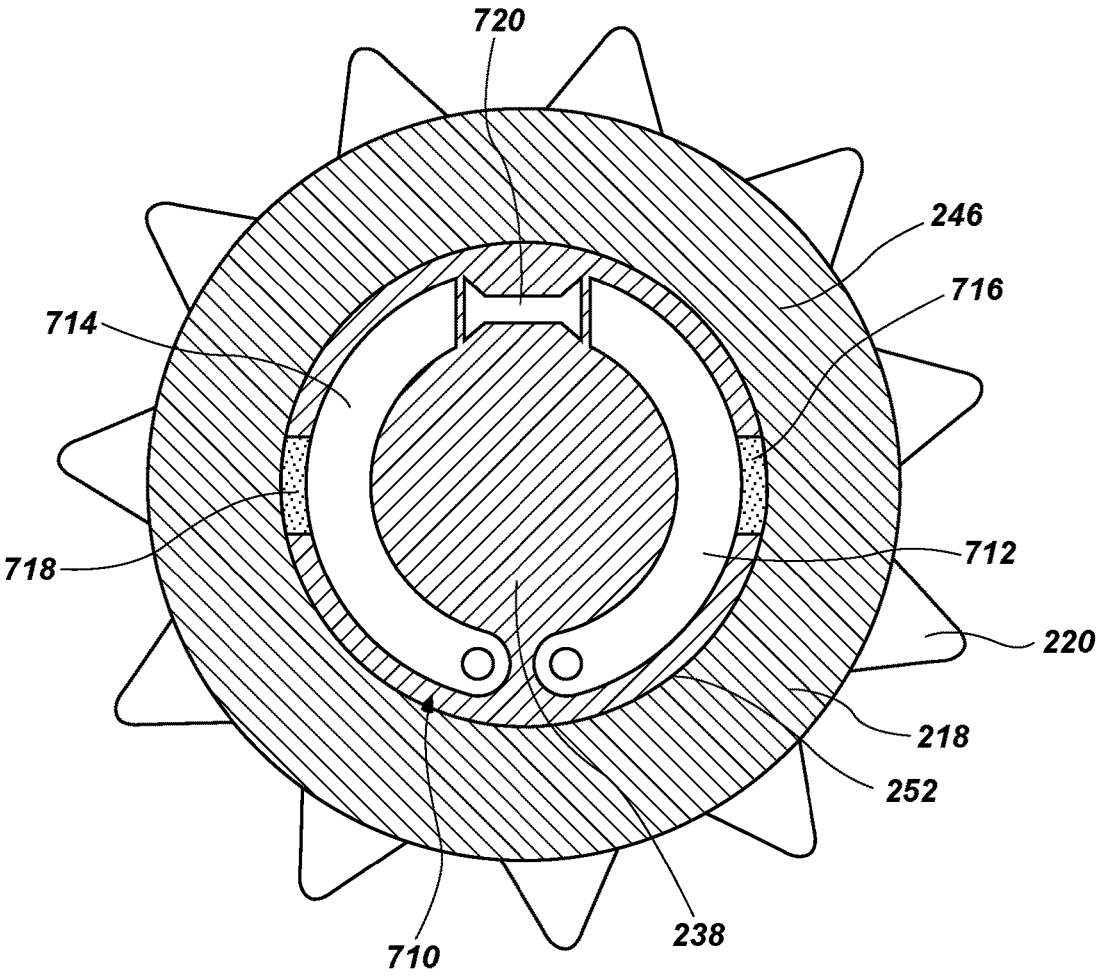
FIG. 7 is an enlarged partial cross-sectional view of a resistance actuator according to an embodiment of the present disclosure.

FIG. 7 is a front cross-sectional view of a rotatable cutting structure 218 rotatably mounted to a head 238 of a leg 216 having a resistance actuator 260 including self-energizing brakes. For example, as shown in FIG. 7, the resistance actuator 260 may include shoe drum brakes 710. In such embodiments, the shoe drum brakes 710 may include a leading shoe 712, a trailing shoe 714, a first pad 716, a second pad 718, and an expander 720. The leading shoe 712 and trailing shoe 714 may be disposed within the head 238 of the leg 216 and may be pivotally connected to the head 238 at one end, and the first and second pads 716, 718 may be attached to the leading and trailing shoes 712, 714, respectively, and may be located to press up against the body 246 of the rotatable cutting structure 218 at the interface 252 of the head 238 and the rotatable cutting structure 218. The expander 720 may be disposed between the leading shoe 712 and the trailing shoe 714 at ends of the leading shoe 712 and the trailing shoe 714 opposite the pivotally connected ends. The expander 720 may be configured to separate the leading shoe 712 and the trailing shoe 714, and as a result, cause the leading shoe 712 and the trailing shoe 714 to pivot about their pivotally connected ends and to press the first pad 716 and the second pad 718 against the body 246 of the rotatable cutting structure 218. For example, the shoe drum brakes 710 may function in a similar manner to shoe drum brakes known in the art. When the shoe drum brakes 710 are actuated, the first pad 716 of the leading shoe 712 may be pressed against the rotatable cutting structure 218, and a friction force experienced on the first pad 716 may cause the leading shoe 712 to pivot about its pivotally connected end and to further press the first pad 716 against the rotatable cutting structure 218, thus increasing a force pressing the first pad 716 against the rotatable cutting structure 218. Accordingly, the shoe drum brakes 710 are self-energizing. Moreover, pressing the first pad 716 of the leading shoe 712 and the second pad 718 of the trailing shoe 714 against the body 246 of the rotatable cutting structure 218 may impose rotational resistance to the rotatable cutting structure 218.

Figure 8:
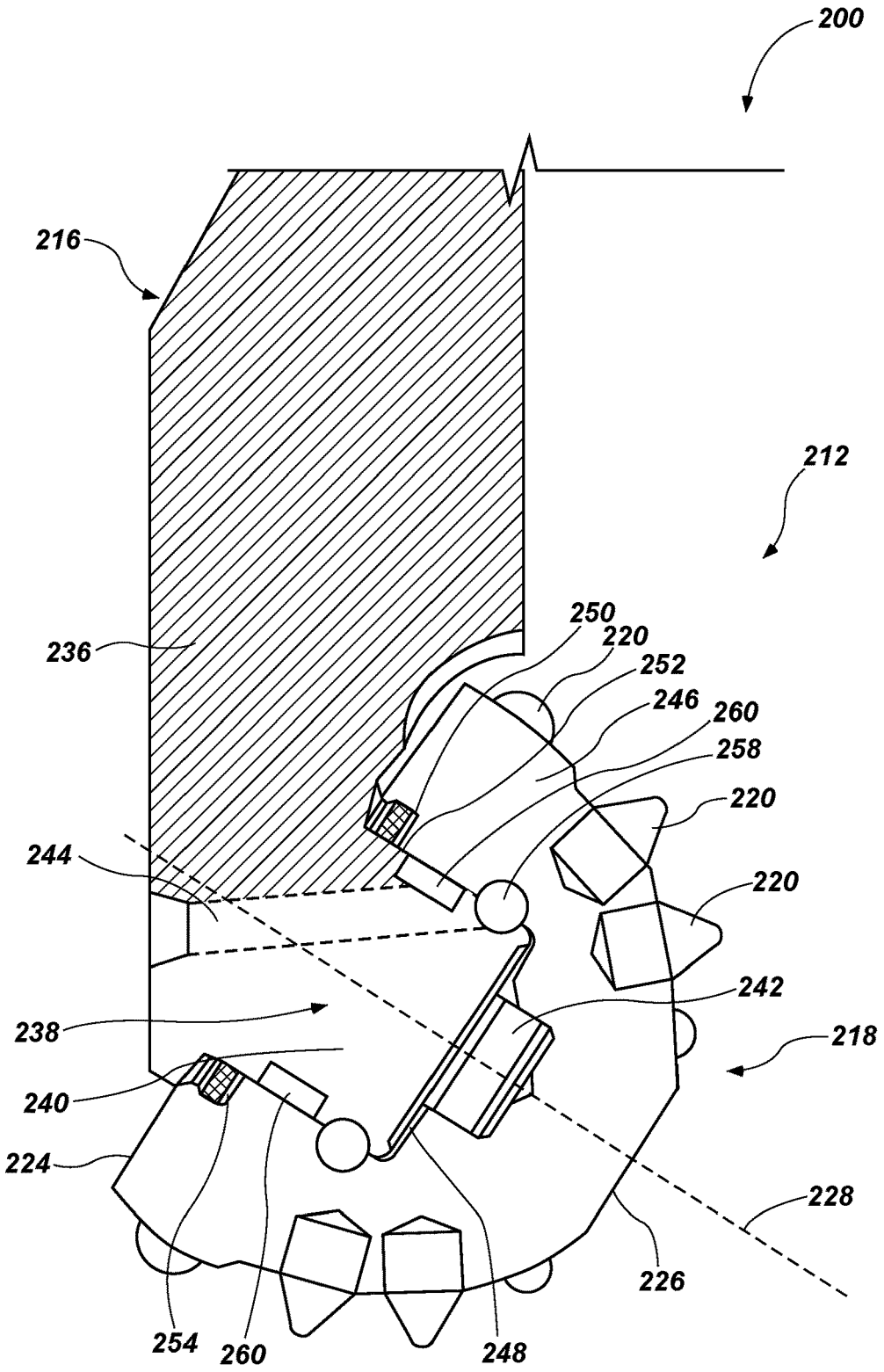
FIG. 8 is a partial cross-sectional view of a leg and rotatable cutting structure assembly of an earth-boring tool according to another embodiment of the present disclosure.
Figure 9:
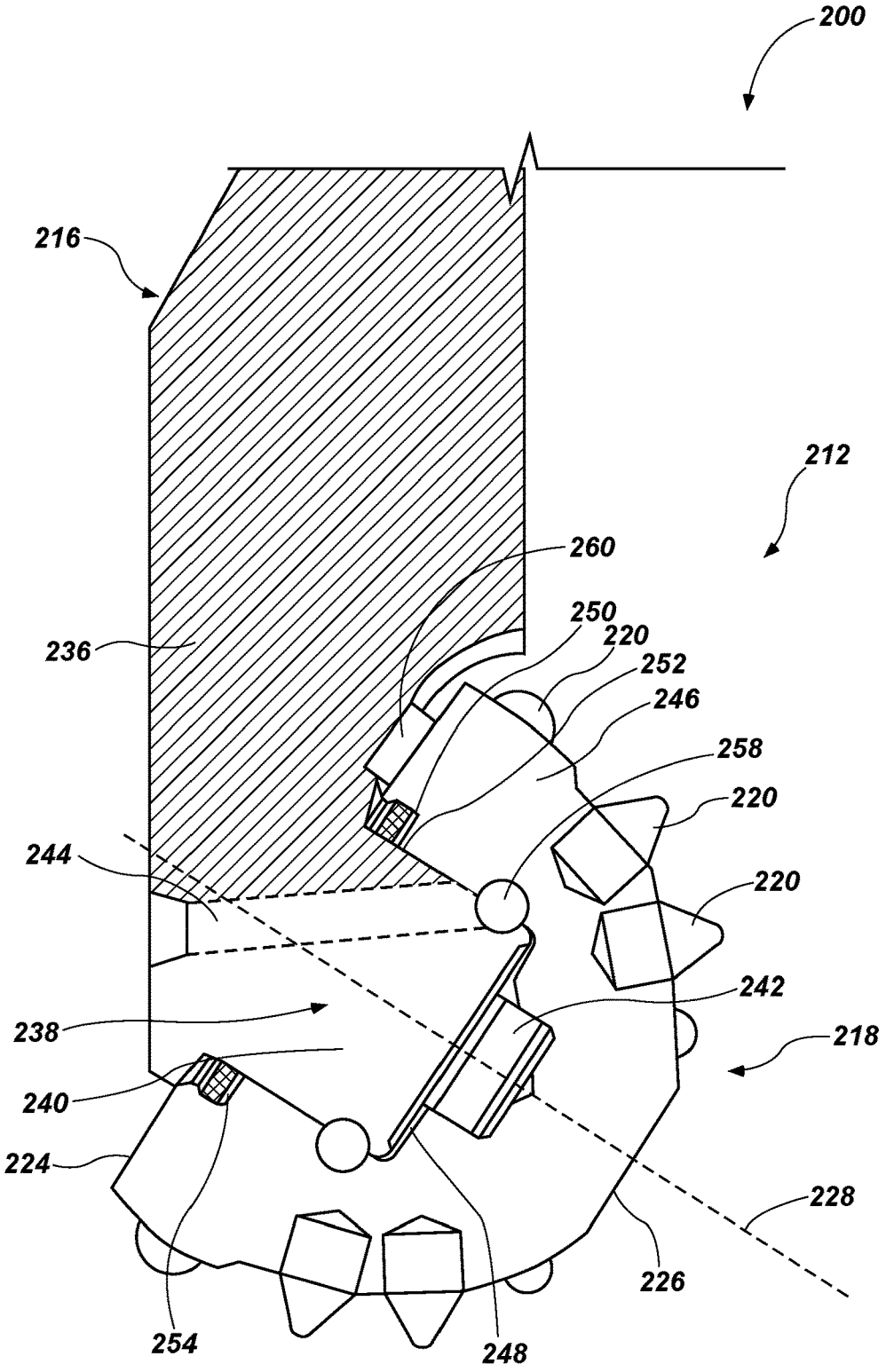
FIG. 9 is a partial cross-sectional view of a leg and rotatable cutting structure assembly of an earth-boring tool according to another embodiment of the present disclosure.
Figure 10:
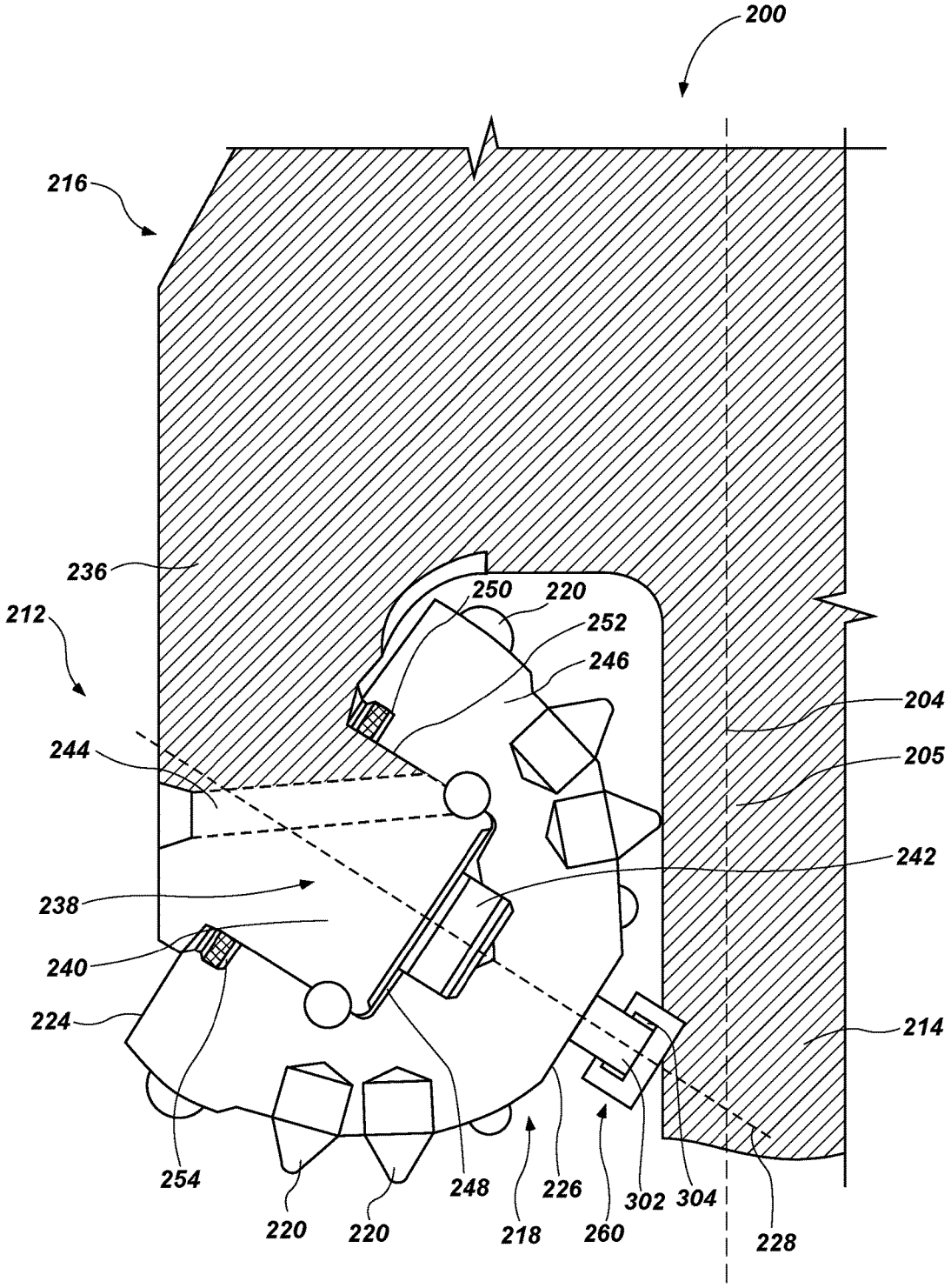
FIG. 10 is a partial cross-sectional view of a leg and rotatable cutting structure assembly of an earth-boring tool according to another embodiment of the present disclosure.

FIGS. 8-10 are partial cross-sectional views of other rotatable cutting structure assemblies 212 of earth-boring tools 200 according to other embodiments of the present disclosure. As shown in FIG. 8, in some embodiments, the resistance actuator 260 may be disposed within the head 238 of the leg 216 and at an interface 252 of the body 246 of the rotatable cutting structure 218 and the head 238. As shown in FIG. 9, in some embodiments, the resistance actuator 260 may be disposed within the leg portion 236 of the leg 216 and proximate the body 246 of the rotatable cutting structure 218 such that the resistance actuator 260 may impose rotational resistance to the rotatable cutting structure 218. As would be recognized by one of ordinary skill in the art, the resistance actuator 260 could be disposed anywhere within the leg 216 of the earth-boring tool 200 that would allow the resistance actuator 260 to impose resistance to the rotation of the rotatable cutting structure 218. As shown in FIG. 10, in some embodiments, the resistance actuator 260 may include a shaft 302 extending from the radially innermost end 226 of the rotatable cutting structure 218 and a braking mechanism 304 coupled to the shaft 302. The braking mechanism 304 may be attached to a blade 214 proximate the axial center 204 of the earth-boring tool 200. The braking mechanism 304 may impose resistance to the rotation of the rotatable cutting structure 218 by applying resistance to the rotation of the shaft 302. For example, the braking mechanism 304 may include any of the above described resistance actuators 260.

Referring to FIGS. 1 and 10 together, for example, the resistance actuator 260 of FIG. 10 may be disposed in a space between the rotatable cutting structure 218 and the axial center 204 of the earth-boring tool 200 created by the radially innermost end 226 of the rotatable cutting structure 218 being distanced from the axial center 204, as described above in regard to FIG. 1.

Referring to FIGS. 1-10 together, adding rotational resistance to at least one rotatable cutting structure 218 of the plurality of rotatable cutting structures 218 of the earth-boring tool 200 may cause a blade 214 of the earth-boring tool 200 to be pushed into a sidewall 138 of a borehole 102 of which the earth-boring tool 200 is drilling during a drilling operation. In other words, adding rotational resistance to at least one rotatable cutting structure 218 of the plurality of rotatable cutting structures 218 of the earth-boring tool 200 may cause the earth-boring tool 200 to at least partially pivot (e.g., rotate, turn, swivel, revolve, and/or spin) about rotatable cutting structure 218 (e.g., the rotatable cutting structure 218 to which rotational resistance is imposed) and may cause the earth-boring tool 200 to push a trailing blade 214 (i.e., a blade 214 trailing the rotatable cutting structure 218) into the side wall 138 of the borehole 102 of which the earth-boring tool 200 is drilling during a drilling operation. In some embodiments, adding rotational resistance to at least one rotatable cutting structure 218 of the plurality of rotatable cutting structures 218 of the earth-boring tool 200 may cause a blade 214 of the earth-boring tool 200 angularly trailing the at least one rotatable cutting structure 218 by about 75° to about 145° to be pushed into the sidewall 138 of the borehole 102. In other words, a leading face 232 of the blade 214 pushed into the sidewall 138 and the rotational axis 228 of the rotatable cutting structure 218 to which the rotation resistance is imposed may define an angle within the range of about 75° to about 145°. For example, in some embodiments, the angle may be about 90°. In other embodiments, the angle may be about 120°.

In some embodiments, adding rotational resistance to at least one rotatable cutting structure 218 of the plurality of rotatable cutting structures 218 of the earth-boring tool 200 may cause another portion (instead of or in addition to the blade 214) of the earth-boring tool 200 to be pushed into a sidewall 138 of a borehole 102 of which the earth-boring tool 200 is drilling during a drilling operation. For example, in some embodiments, adding rotational resistance to at least one rotatable cutting structure 218 of the plurality of rotatable cutting structures 218 of the earth-boring tool 200 may cause one or more of another rotatable cutting structure 218 or a leg of a rotatable cutting structure assembly 212 to be pushed into a sidewall 138 of a borehole 102 of which the earth-boring tool 200 is drilling during a drilling operation.

Pushing a trailing blade 214 into the sidewall 138 (e.g., a longitudinal inside wall) of the borehole 102 of which the earth-boring tool 200 is drilling, may cause the trailing blade 214 to side cut into the sidewall 138 of the borehole 102. For example, in some embodiments, the plurality of blades 214 of the earth-boring tool 200 may have side cutting abilities. As a non-limiting example, the plurality of blades 214 of the earth-boring tool 200 may include cutting element having orientations for side cutting as described in U.S. Pat. No. 8,047,307, to Pessier et al., issued Nov. 1, 2011, the disclosure of which is incorporated in its entirety by reference herein. Causing the trailing blade 214 to side cut into the sidewall 138 of the borehole 102 may cause the earth-boring tool 200 to cause the borehole 102 to build (e.g., change in inclination over a length (e.g., depth) of the borehole 102). In other words, causing the trailing blade to side cut into the sidewall 138 of the borehole 102 may cause the earth-boring tool 200 to change a direction in which the earth-boring tool 200 is drilling. Put another way, causing the trailing blade to side cut into the sidewall 138 of the borehole 102 may alter a trajectory of the earth-boring tool 200 within the borehole 102.

Figure 11:
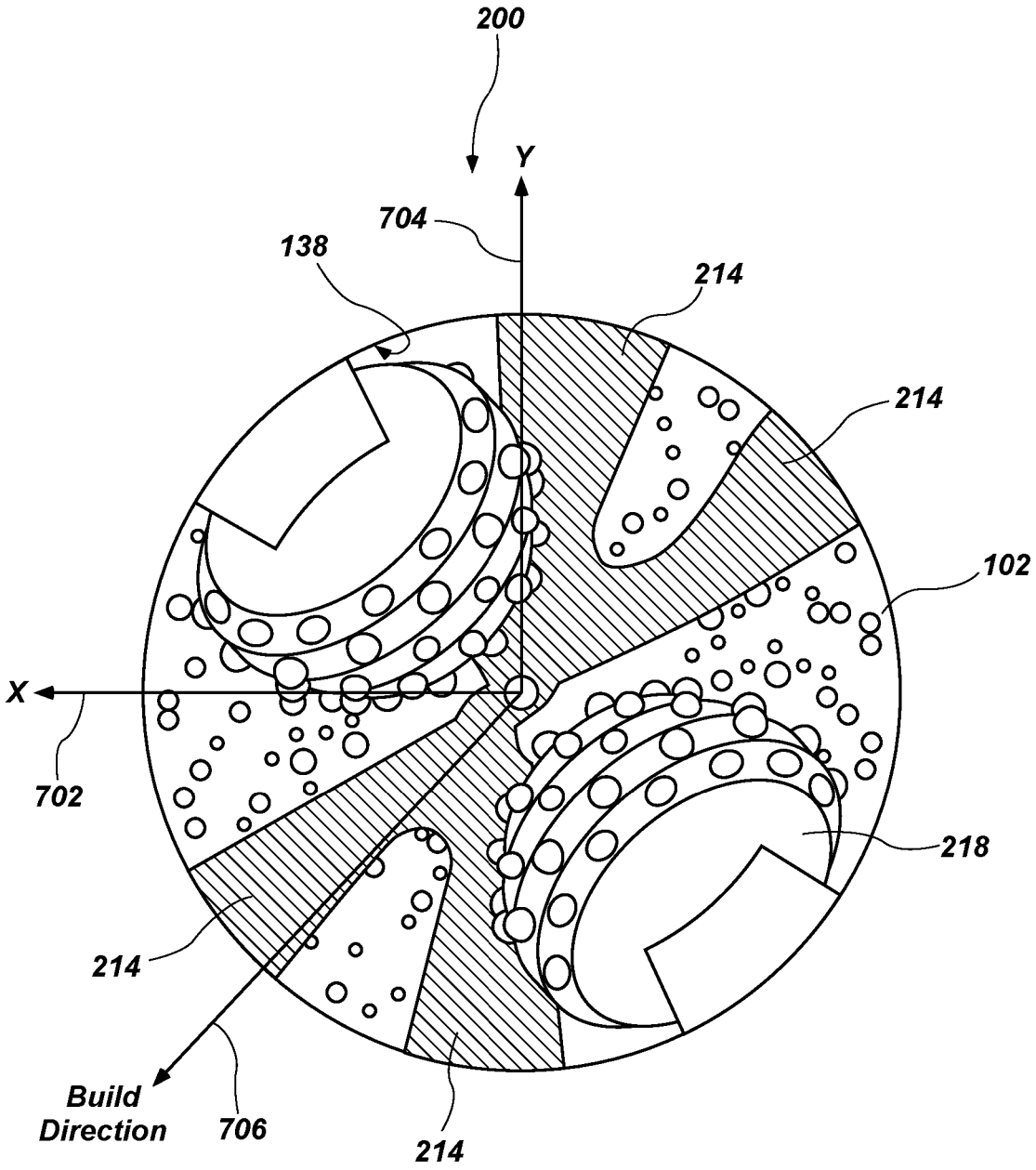
FIG. 11 is a top partial cross-sectional view of a hybrid bit in a borehole according to an embodiment of the present disclosure.

FIG. 11 is a top partial cross-sectional view of the plurality of blades 214 and plurality of rotatable cutting structures 218 of the earth-boring tool 200 of FIG. 1 disposed within a borehole 102. Some elements of the earth-boring tool 200 are removed to better show internal elements of the earth-boring tool 200. In some embodiments, adding rotational resistance to one or more rotatable cutting structures 218 of the earth-boring tool 200 may be synchronized relative to an angular position of the one or more rotatable cutting structures 218 of the earth-boring tool 200 relative to the borehole 102. For example, rotational resistance may be added to a rotatable cutting structure 218 during a portion of each full rotation of the earth-boring tool 200 within the borehole 102. Furthermore, rotational resistance may be added to the rotatable cutting structure 218 during a same portion of each full rotation of the earth-boring tool 200 for multiple rotations of the earth-boring tool 200. For example, rotational resistance may be added to the rotatable cutting structure 218 for 90° of a full rotation (e.g., one-quarter rotation). In some embodiments, rotational resistance may be added to the rotatable cutting structure 218 for 120° of a full rotation (e.g., one-third rotation). Although specific portions of a full rotation of the earth-boring tool 200 are described, one of ordinary skill in the art would readily recognize that rotational resistance may be added to a rotatable cutting structure 218 for any portion of a full rotation of the earth-boring tool 200.

In some embodiments, rotational resistance may be added to each rotatable cutting structure 218 of the plurality of rotatable cutting structures 218 of the earth-boring tool 200 while each rotatable cutting structure 218 of the plurality of rotatable cutting structures 218 is within a range of angular positions (e.g., a portion), relative to the formation, of a full rotation of the earth-boring tool 200. For example, rotational resistance may be added to a first rotatable cutting structure 218 of the plurality of rotatable cutting structures 218 while the first rotatable cutting structure 218 is within the range of angular positions (e.g., a portion) of a full rotation of the earth-boring tool 200, and the rotational resistance may be removed when the first rotatable cutting structure 218 leaves the range of angular positions. Subsequently, rotational resistance may be added to a second different rotatable cutting structure 218 of the plurality of rotatable cutting structures 218 when the second rotatable cutting structure 218 reaches the range of angular positions of the full rotation of the earth-boring tool 200 and may be removed when the second rotatable cutting structure 218 leaves the range of angular positions.

Adding rotational resistance to a rotatable cutting structure 218 or multiple rotatable cutting structures 218 of the earth-boring tool 200 for the same portion of each full rotation of the earth-boring tool 200 for multiple rotations of the earth-boring tool 200 may cause a trailing blade 214 to cut into the sidewall 138 of the borehole 102 in a same location during each rotation of the earth-boring tool 200. As a result, the earth-boring tool 200 and borehole 102 may build in a direction in which the earth-boring tool 200 (e.g., the trailing blade 214) is side cutting into the sidewall 138 of the borehole 102.

As a non-limiting example and as shown in FIG. 11, rotational resistance may be added to each rotatable cutting structure 218 of the plurality of rotatable cutting structures 218 of the earth-boring tool 200 while the rotational axis 228 of each rotatable cutting structure 218 is within the angular positions between an X-direction 702 and a Y-direction 704, perpendicular to the X-direction 702 (e.g., about 90°). Furthermore, for embodiments where a blade 214 trailing each rotatable cutting structures 218 by about 90° is pushed into a sidewall 138 of the borehole 102, when rotational resistance is added to the rotatable cutting structures 218 within the angular positions between the X-direction 702 and the Y-direction 704 shown in FIG. 11, the earth-boring tool 200 may build in a build direction 706 as shown in FIG. 11.

In a first simulation test performed by the inventors, adding a rotational resistance (e.g., braking torque) to each rotatable cutting structure 218 of the plurality of rotatable cutting structures 218 of an earth-boring tool 200 at a same angular position of the rotatable cutting structures 218 relative to the borehole 102 (or rotation of the earth-boring tool 200) resulted in a build rate of the earth-boring tool 200 on par with conventional drilling motor assemblies and rotary steerable systems ("RSS") used for directional drilling, such as the AUTOTRAK® rotary steerable system commercially available from Baker Hughes International of Houston, Tex. In the first test, the earth-boring tool 200 was simulated drilling into limestone at 120 rotations-per-minute ("RPM") with about 100 ft/lbs of braking torque imposed the rotatable cutting structures 218 for a same 90° of each full rotation of the earth-boring tool 200. The earth-boring tool 200 experienced a change in the X-direction 702 ("dx") within a plane to which the longitudinal length of the borehole 102 is orthogonal (e.g., plane of FIG. 6) of about 0.006 inch and a change in the Y-direction 704 ("dy") perpendicular to the x-direction 702 and within the plane of about 0.006 inch over a drilled distance ("dz") of 0.8 inch (about 16 rotations). Furthermore, the earth-boring tool 200 experienced an overall change in direction ("dl") within the plane (i.e., total distance of side cut, $dl=\sqrt{dx^2+dy^2}$) of about 0.008 inch. Accordingly, the build rate (dl/dz) experienced by the earth-boring tool 200 was about 0.011 (about 6°/100 ft100 ft). The rotatable cutting structures 218, to which rotational resistance was added, experienced about a 4% decrease in RPM (about 4 RPM).

In a second simulation test performed by the inventors, the earth-boring tool 200 was simulated drilling into limestone at 120 rotations-per-minute ("RPM") with about 200 ft/lbs of braking torque imposed the rotatable cutting structures 218 for 90° (i.e., a quarter rotation) of each full rotation of the earth-boring tool 200. The earth-boring tool 200 experienced a change in the X-direction 702 ("dx") of about 0.011 inch and a change in the Y-direction 704 ("dy") of about 0.011 inch over a drilled distance ("dz") of 0.8 inch (about 16 rotations). Furthermore, the earth-boring tool 200 experienced an overall change in direction ("dl") (i.e., total distance of side cut, $dl=\sqrt{dx^2+dy^2}$) of about 0.016 inch. Accordingly, the build rate (dl/dz) experienced by the earth-boring tool 200 was about 0.02 (about 12°/100 ft).

Referring to FIGS. 1-11 together, each resistance actuator 260 of the earth-boring tool 200 (e.g., the resistance actuator 260 of each rotatable cutting structure assembly 212 of the earth-boring tool 200) may be controlled by one or more of the controller unit 142 and the surface control unit 128 of the drilling assembly 114. In some embodiments, the resistance actuators 260 of the earth-boring tool 200 may be actively controlled by one or more of the controller unit 142 and the surface control unit 128 of the drilling assembly 114. For clarity of explanation, the resistance actuators 260 will be described herein as being controlled by the controller unit 142. However, it is understood that any of the actions described herein may be performed by one or more the controller unit 142 and the surface control unit 128.

The controller unit 142 may provide electrical signals, power, and/or a communication signals to the resistance actuators 260 to operate to the resistance actuators 260. For example, the controller unit 142 and/or surface control unit 128 may be operably coupled to the resistance actuator 260 via lines extending through the earth-boring tool 200 and/or drill string 110. In some embodiments, an operator operating the drill string 110 and drilling assembly 114 may actively control the resistance actuators 260 of the earth-boring tool 200 and, as a result, the build rates of the borehole 102 in real time. In some embodiments, the resistance actuators 260 of the earth-boring tool 200 may be automatically actively controlled by the controller unit 142 based on data acquired by the one or more of the sensors 140. For example, one or more of the sensors 140 may acquire data about a condition downhole (e.g., within the borehole 102), and the controller unit 142 may operate the resistance actuators 260 of the plurality of rotatable cutting structure assemblies 212 in response to the condition. Such conditions may include formation 118 characteristics, vibrations (torsional, lateral, and axial), WOB, sudden changes in DOC, desired ROP, stick-slip, temperature, pressure, depth of borehole 102, position of earth-boring tool 200 in the formation 118, etc.

Furthermore, in some embodiments, a desired profile of the borehole 102 may be known, and the controller unit 142 may be programmed to calculate needed build rates of the borehole 102 in one or more directions to achieve the desired profile of the borehole 102. For example, a target point (e.g., oil source, type of formation, fluid source, etc.) within a formation 118 may be known, and the controller unit 142 may be programmed to calculate needed build rates of the borehole 102 in one or more directions to reach the target point, and the controller unit 142 may operate the resistance actuator 260 such that the drilling assembly 114 is directed to and reaches the target point. Put another way, the controller unit 142 may operate the resistance actuators 260 of the earth-boring tool 200 to perform directional drilling with the earth-boring tool 200. For example, the controller unit 142 may operate the resistance actuators 260 of the earth-boring tool 200 to drill horizontal wells, straighten skewed (e.g., crooked) boreholes, perform sidetracking, perform geo-steering, perform geo-stopping, etc.

Figure 12:
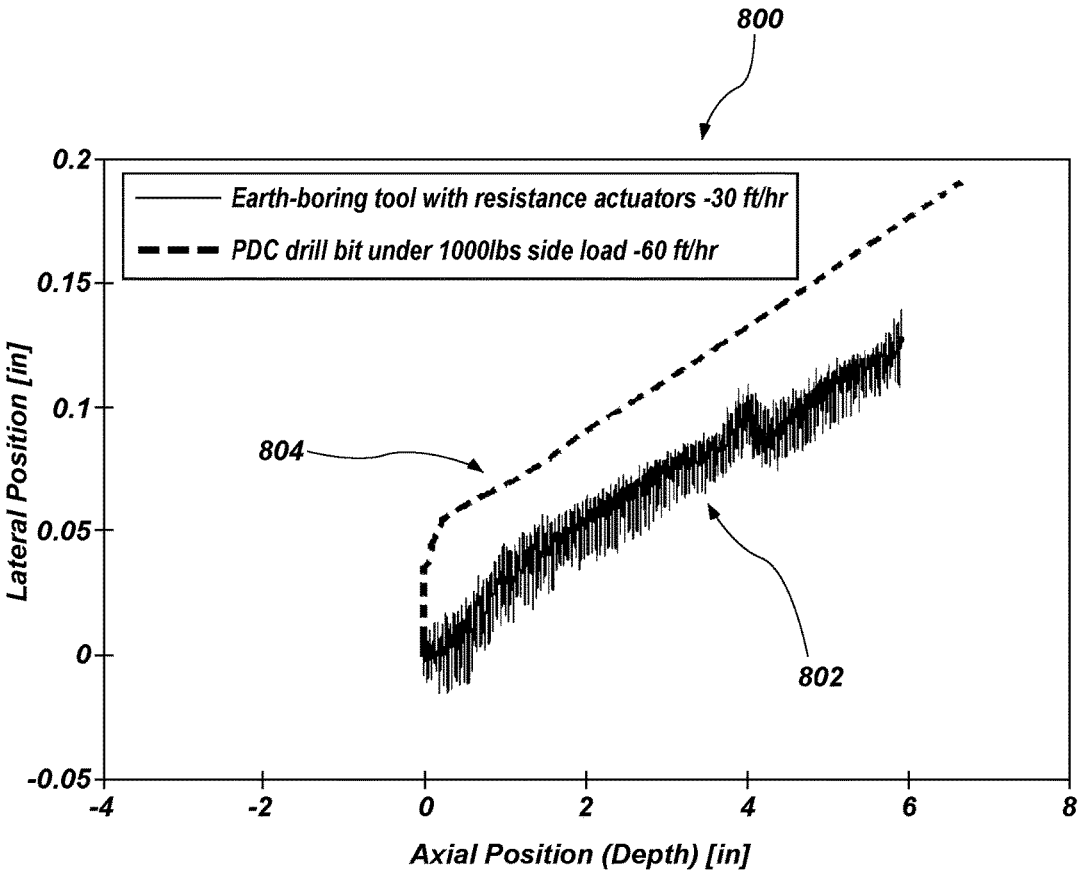
FIG. 12 is a graphical representation of a comparison of build rate of an earth-boring tool of the present disclosure and a conventional drill bit.

FIG. 12 shows a graphical comparison 800 of a build rate 802 of a simulated earth-boring tool 200 (FIG. 2) of the present disclosure and a build rate 804 of a simulated polycrystalline diamond compact ("PDC") bit having a side load. Referring to FIGS. 2 and 12 together, the earth-boring tool 200 was simulated as drilling at a rate of 30 ft/hr. The earth-boring tool 200 was further simulated as having blades 214 trailing the rotatable cutting structures 218 by about 90°. Rotational resistance was added to the rotatable cutting structures 218 for about 90° of each full rotation of the earth-boring tool 200. The PDC bit was simulated as drilling at a rate of 60 ft/hr and having a side load of 2000 lbs (e.g., a push-the-bit RSS). As shown in FIG. 12, the earth-boring tool 200 of the present disclosure experienced substantially a same build rate as the PDC bit. Furthermore, as shown, the earth-boring tool 200 of the present disclosure avoids a sudden change in lateral position without a substantial change in axial position (e.g., "the knee" experienced by the PDC bit and as shown in FIG. 12). By avoiding "the knee," the earth-boring tool 200 of the present disclosure may provide advantages over an RSS by providing a more predictable and consistent build rate.

Referring again to FIGS. 1-11 together, in some embodiments, rotational resistance may be added to a first rotatable cutting structure 218 of the plurality of rotatable cutting structures 218 and a rotation of a second rotatable cutting structure 218 opposite to (e.g., a rotatable cutting structure 218 on an opposite side of the earth-boring tool 200 than) the first rotatable cutting structure 218 of the plurality of rotatable cutting structures 218 may be increased at a same time during a portion of a full rotation of the earth-boring tool 200. For example, a rotational axis 228 of the first rotatable cutting structure 218 and the rotation axis of the second rotatable cutting structure 218 may be about 180° apart, and a motor may be coupled to second rotatable cutting structure 218 to increase a rotation speed of the second rotatable cutting structure 218. Increasing a rotation speed of the second rotatable cutting structure 218 may increase an effectiveness of the first rotatable cutting structure 218 in causing the earth-boring tool 200 to side cut the sidewall 138 of the borehole 102. For example, increasing a rotation speed of the second rotatable cutting structure 218 may increase a force pushing the blade 214 trailing the first rotatable cutting structure 218 into the sidewall 138 of the borehole 102.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth-boring tool, comprising:
- a body; and
- at least one rotatable cutting structure assembly coupled to the body and comprising:
  - a leg extending from the body;
  - a rotatable cutting structure rotatably coupled to the leg; and
  - a resistance actuator configured to impose rotational resistance on the rotatable cutting structure relative to the leg and comprising at least one self-energizing brake, wherein the resistance actuator is configured to impose rotational resistance on the rotatable cutting structure for only a portion of each full rotation of the earth-boring tool within a borehole; and
- a plurality of blades coupled to the body.

2. The earth-boring tool of claim 1, further comprising at least one blade coupled to the body of the earth-boring tool.

3. The earth-boring tool of claim 1, wherein the leg of the at least one rotatable cutting structure assembly further comprises:
- a leg portion extending from the body; and
- a head for rotatably coupling the rotatable cutting structure to the leg and extending from the leg portion, a longitudinal axis of the head forming an acute angle with a longitudinal axis of the leg portion of the leg.

4. The earth-boring tool of claim 3, wherein the resistance actuator is disposed within a body of the rotatable cutting structure and at an interface of the body of the rotatable cutting structure and the head of the leg.

5. The earth-boring tool of claim 3, wherein the resistance actuator is disposed within the head at an interface of a body of the rotatable cutting structure and the head of the leg.

6. The earth-boring tool of claim 1, wherein the resistance actuator is disposed at an interface of the leg of the at least one rotatable cutting structure assembly and the rotatable cutting structure of the at least one rotatable cutting structure assembly.

7. The earth-boring tool of claim 1, wherein the resistance actuator comprises:
- a leading shoe pivotally connected to the leg;
- a trailing shoe pivotally connected to the leg;
- a first pad secured to the leading shoe and oriented to press up against a body of the rotatable cutting structure;
- a second pad secured to the trailing shoe and oriented to press up against the body of the rotatable cutting structure; and
- a expander disposed between the leading shoe and the trailing shoe and configured to separate the leading shoe from the trailing shoe.

8. An earth-boring tool, comprising:
- a body;
- a plurality of rotatable cutting structure assemblies coupled to the body, each rotatable cutting structure assembly of the plurality of rotatable cutting structure assemblies comprising:
  - a leg extending from the body;
  - a rotatable cutting structure rotatably coupled to the leg; and
  - a resistance actuator configured to impose rotational resistance on the rotatable cutting structure relative to the leg and comprising at least one self-energizing brake, wherein the resistance actuator is configured to impose rotational resistance on the rotatable cutting structure for only a portion of each full rotation of the earth-boring tool within a borehole; and
- a plurality of blades coupled to the body.

9. The earth-boring tool of claim 8, wherein the resistance actuator comprises:
- a shaft extending from a radially innermost end of the rotatable cutting structure of the at least one rotatable cutting structure assembly; and
- a braking mechanism coupled to the shaft and configured to impose rotational resistance to the shaft.

10. The earth-boring tool of claim 8, wherein at least one blade of the plurality of blades is located between adjacent rotatable cutting structure assemblies of the plurality of rotatable cutting structure assemblies.

11. The earth-boring tool of claim 8, wherein a rotational axis of a first rotatable cutting structure of the plurality of rotatable cutting structure assemblies is spaced apart from a rotational axis of a second adjacent rotatable cutting structure of the plurality of rotatable cutting structure assemblies by 180°.

12. The earth-boring tool of claim 8, wherein a rotational axis of a first rotatable cutting structure of the plurality of rotatable cutting structure assemblies is spaced apart from a rotational axis of a second adjacent rotatable cutting structure of the plurality of rotatable cutting structure assemblies by 120°.

13. The earth-boring tool of claim 8, wherein a rotational axis of a rotatable cutting structure of a rotatable cutting structure assembly of the plurality of rotatable cutting structure assemblies is spaced apart from a leading face of a blade of the plurality of blades trailing the rotatable cutting structure by 120°.

14. The earth-boring tool of claim 8, further comprising a controller unit operably coupled to the resistance actuator of each rotatable cutting structure assembly of the plurality of rotatable cutting structure assemblies and configured to operate each resistance actuator.

15. A method of drilling a borehole, comprising:

rotating an earth-boring tool within the borehole;

causing rotational resistance to be imposed on at least one rotatable cutting structure coupled to a leg of the earth-boring tool to alter a speed of rotation of the at least one rotatable cutting structure relative to the leg by imposing rotation resistance on the at least one rotatable cutting structure with a self-energizing brake for only a portion of each full rotation of the earth-boring tool within a borehole;

causing a portion of the earth-boring tool to be pushed into a sidewall of the borehole responsive to the rotational resistance imposed on the at least one rotatable cutting structure; and side cutting a sidewall of the borehole with the portion of the earth-boring tool.

16. The method of claim 15, wherein causing a portion of the earth-boring tool to be pushed into a sidewall of the borehole comprises causing a blade of the earth-boring tool to be pushed into the sidewall of the borehole.

17. The method of claim 16, wherein causing a blade of the earth-boring tool to be pushed into a sidewall of the borehole comprises causing a blade having a leading face trailing a rotational axis of the at least one rotatable cutting structure upon which rotational resistance is imposed by about 120° to be pushed into the sidewall of the borehole.

18. The method of claim 15, wherein causing a portion of the earth-boring tool to be pushed into a sidewall of the borehole comprises causing another rotatable cutting structure of the earth-boring tool to be pushed into the sidewall of the borehole.

19. The method of claim 16, causing rotational resistance to be imposed on at least one rotatable cutting structure of the earth-boring tool comprises causing rotational resistance to be imposed on the at least one rotatable cutting structure of the earth-boring tool for about 120° of a full rotation of the earth-boring tool.

20. The earth-boring tool of claim 8, wherein a rotational axis of a rotatable cutting structure of a rotatable cutting structure assembly of the plurality of rotatable cutting structure assemblies is spaced apart from a leading face of a blade of the plurality of blades trailing the rotatable cutting structure by 90°.

* * * * *